US006375740B1

(12) United States Patent
Ogino et al.

(10) Patent No.: US 6,375,740 B1
(45) Date of Patent: Apr. 23, 2002

(54) HOT DIPPING APPARATUS

(75) Inventors: Isao Ogino; Yukikazu Aoki, both of Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/678,321

(22) Filed: Oct. 3, 2000

(30) Foreign Application Priority Data

Oct. 4, 1999 (JP) ..... 11-282883

(51) Int. Cl.[7] ..... B05C 13/00
(52) U.S. Cl. ..... 118/66; 118/666
(58) Field of Search ..... 164/267, 268, 164/461, 419, 335, 154.6; 118/61, 66, 429, 666, 695

(56) References Cited

U.S. PATENT DOCUMENTS 3,648,655 A * 3/1972 Killin et al.

FOREIGN PATENT DOCUMENTS

| | | |
|---|---|---|
| JP | 53-100136 A | 1/1978 |
| JP | 56-15710 | 4/1981 |
| JP | 57-3746 | 1/1982 |
| JP | 8-291325 A | 5/1996 |
| JP | 11-12658 A | 1/1999 |

* cited by examiner

*Primary Examiner*—Brenda A. Lamb
(74) *Attorney, Agent, or Firm*—Oliff & Berridge, PLC

(57) ABSTRACT

A heating furnace (2) heats a workpiece to be plated. An ingot preheating furnace (8) encloses an ingot carrying device (7) that carries ingots (6) to a place near a melting furnace (3) that melts the ingots (6) of a plating material, contains the molten plating material in which a workpiece to be plated is immersed. The ingot preheating furnace (8) preheats the ingots (6) supported by the ingot carrying device (7) at a temperature below the melting point of the ingots (6) by an exhaust gas (G) discharged from the heating furnace (2).

9 Claims, 5 Drawing Sheets

HOT DIPPING APPARATUS

BACKGROUND OF THE INVENTION

1. Field of the Invention

The present invention relates to a hot dipping apparatus employed in a manufacturing line for manufacturing hot-dip zinc-coated steel sheets or the like.

2. Description of the Related Art

A hot dipping apparatus for manufacturing hot-dip zinc-coated steel sheets carries out a pretreatment process, such as a continuous heating process for heating steel sheets or a continuous annealing process for annealing steel sheets. A steel sheet unwound from a steel sheet coil is passed through a heating furnace and a zinc melting furnace successively for continuous processing. The zinc melting furnace is replenished intermittently with zinc ingots of a room temperature as zinc molten therein is consumed. Zinc ingots to be supplied into the zinc melting furnace are carried to a place near the zinc melting furnace by an ingot carrying device. It is preferable to maintain the molten zinc melted in the zinc melting furnace at temperatures in the range of a predetermined temperature plus and minus 2° C. to maintain constant zinc plating quality. An exhaust gas discharged from the heating furnace is discharged into the atmosphere after being used for preheating combustion air to be supplied into the heating furnace by a heat exchanger.

In the conventional hot dipping apparatus, a zinc ingot of about 1 t having a room temperature, which is far lower than the melting point (460° C.) of zinc, is supplied into the zinc melting furnace. If a zinc ingot of 1 t is dumped at a time into the zinc melting furnace, the temperature of molten zinc contained in the zinc melting furnace drops and zinc plating quality becomes unstable. A zinc ingot may be gradually immersed in molten zinc contained in the zinc melting furnace by using a hoist to prevent zinc plating quality from becoming unstable, which, however, requires skill and labor. It is not easy to maintain the temperature of molten zinc within the predetermined temperature range. It is possible to use an ingot supply device that grips a zinc ingot and immerses the zinc ingot gradually and automatically in the molten zinc, which, however, makes system configuration complicated. The exhaust gas discharged from the heating furnace still has a high temperature in the range of 350 to 450° C. after the same has been used for heating combustion air to be supplied into the heating furnace by the heat exchanger. Therefore, the discharge of the high-temperature exhaust gas into the atmosphere reduces the thermal efficiency of the hot dipping apparatus.

SUMMARY OF THE INVENTION

The present invention has been made in view of the foregoing circumstances and it is therefore an object of the present invention to provide a hot dipping apparatus of simple construction capable of preventing the unstable variation of a molten plating material and of operating at an improved thermal efficiency.

According to the present invention, the hot dipping apparatus includes: a heating furnace for heating or annealing a workpiece to be plated; a melting furnace for melting an ingot of a plating material and containing a molten plating material in which the workpiece is immersed to be coated with the molten plating material for plating; an ingot carrying device for carrying the ingot to a place near the melting furnace; an ingot feed device for feeding the ingot carried by the ingot carrying device into the melting furnace; an ingot preheating furnace mounted so as to enclose the ingot carrying device for preheating the ingot; and an exhaust gas line for supplying an exhaust gas discharged from the heating furnace to the ingot preheating furnace. The exhaust gas to be supplied into the ingot preheating furnace has a temperature below a melting point of the ingot.

In the hot dipping apparatus, the exhaust gas discharged from the heating furnace is supplied into the ingot preheating furnace enclosing the ingot carrying device to preheat the ingot at a temperature below the melting point thereof. Therefore, the hot dipping apparatus operates at a high thermal efficiency and the excessive drop of the temperature of the molten plating material contained in the melting furnace can be prevented when the ingot is fed into the melting furnace.

Preferably, the hot dipping apparatus further includes a temperature controller for maintaining the temperature of the exhaust gas to be supplied into the ingot preheating furnace below the melting point of the ingot.

Since the temperature controller maintains the temperature of the exhaust gas to be supplied into the ingot preheating furnace automatically below the melting point of the ingot, the ingot heated surely at a temperature below the melting point of the ingot can be carried to the place near the melting furnace and hence the ingot will not melt even if the temperature of the exhaust gas discharged from the heating furnace exceeds the melting point of the ingot.

Preferably, the temperature controller has a temperature sensor for measuring the temperature of the exhaust gas to be supplied into the ingot preheating furnace, and a control valve which is opened when the temperature of the exhaust gas measured by the temperature sensor exceeds a set temperature to supply an atmosphere into the exhaust gas supply line to maintain the temperature of the exhaust gas to be supplied into the ingot preheating furnace below the melting point of the zinc ingot.

Preferably, the dipping apparatus further includes a heat exchanger disposed in the exhaust gas line for heating a combustion air to be supplied into the heating furnace by the exhaust gas discharged from the heating furnace.

Preferably, the ingot carrying device is of a pusher system having a pusher for pushing a row of the ingots.

Preferably, the ingot carrying device is of a walking beam system having a stationary beam and a movable beam for advancing the ingot stepwise.

Preferably, the ingot carrying device is of a conveyor system having a belt conveyor for conveying the ingot.

The ingot carrying devices are simple in construction and are capable of being easily enclosed by the ingot preheating furnace and of automatically carrying the ingot to the place near the melting furnace.

Preferably, the ingot preheating furnace has an inlet which can be closed and an outlet which can be closed.

Preferably, the plating material is a zinc and the workpiece to be plated is a steel sheet.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
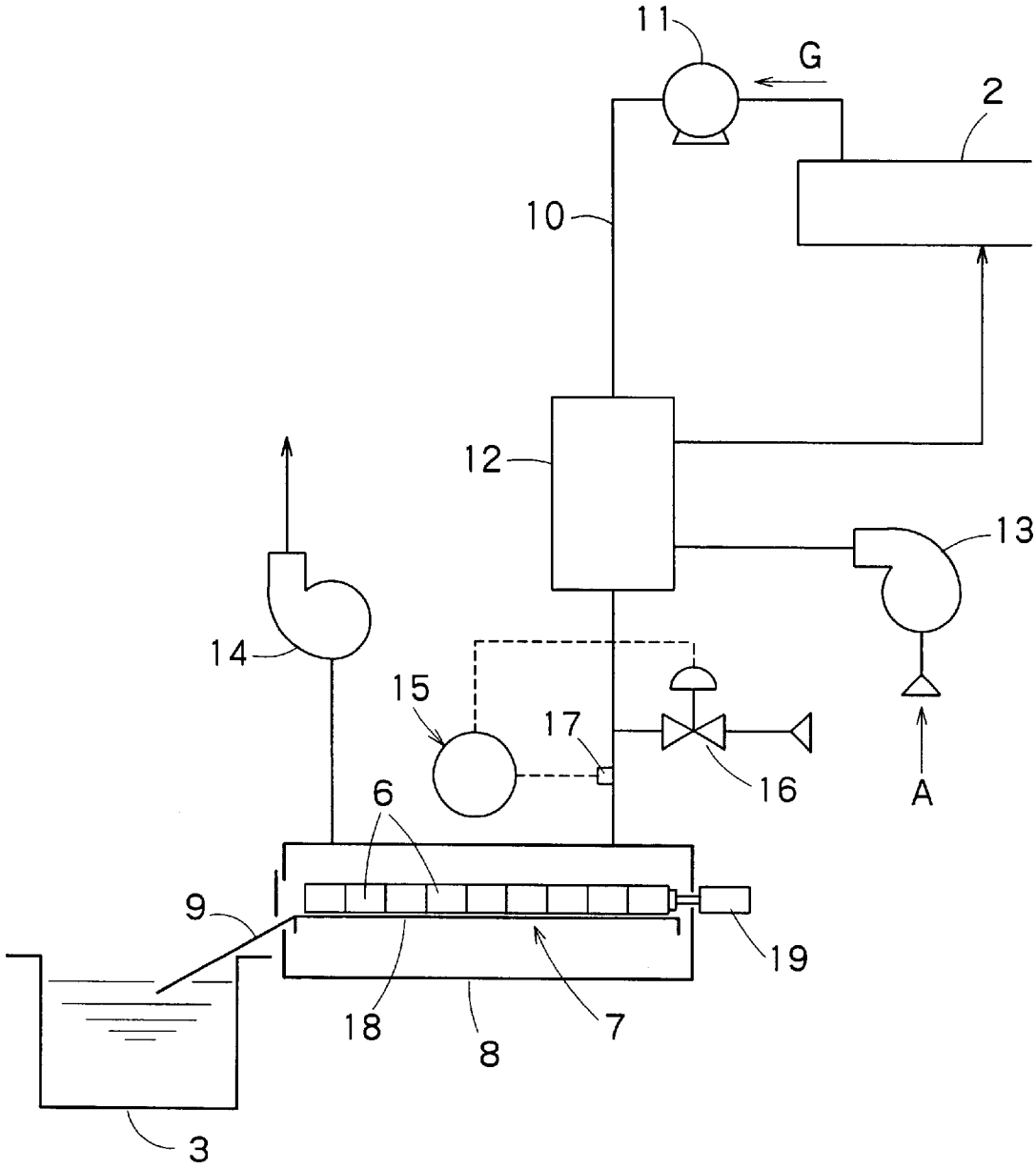
FIG. 1 is block diagram of a hot dipping apparatus in a preferred embodiment according to the present invention.
Figure 2:
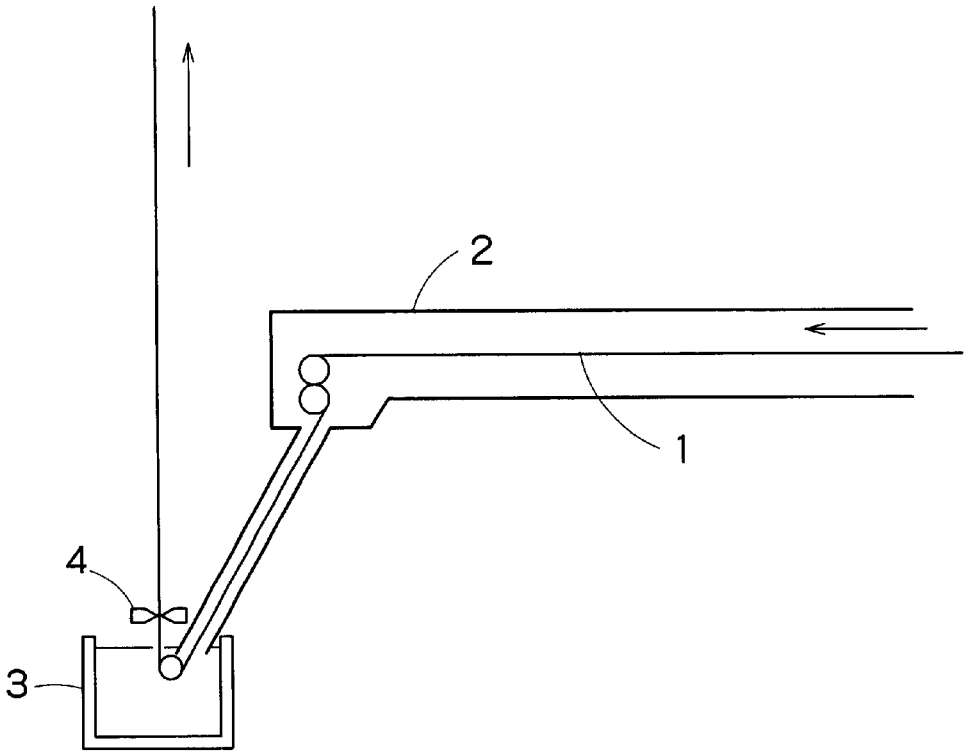
FIG. 2 is a schematic view of a portion of the hot dipping apparatus shown in FIG. 1.

FIG. 1 shows a hot dipping apparatus in a preferred embodiment according to the present invention included in a hot-dip zinc-coated steel sheet manufacturing system, and FIG. 2 shows a section of a path along which a steel sheet 1, i.e. workpiece to be plated, runs. Referring to FIGS. 1 and 2, the steel sheet 1 is unwound from a coil and is heated or annealed by a heating furnace 2 of a burner type. The heated steel sheet 1 is dipped in molten zinc, i.e., a molten plating material, contained in a zinc melting furnace 3. Excess molten zinc is removed from the steel sheet 1 with an air knife 4 to adjust the thickness of a zinc coating on the steel sheet 1. The steel sheet 1 thus coated with the molten zinc is subjected to a cooling process to produce a hot-dip zinc-coated steel sheet.

As shown in FIG. 1, the hot dipping apparatus is provided with an ingot carrying device 7 that carries ingots 6 to a place near the zinc melting furnace 3. The ingot carrying device 7 has an ingot carrying path along which the ingots 6 are carried. The ingot carrying path is enclosed by an ingot preheating furnace 8 for preheating the zinc ingots 6. The zinc ingots 6 are made to slide down along an ingot feed device 9 into the zinc melting furnace 3. Concretely, the ingot feed device 9 is a sloping chute. In FIG. 1, the steel sheet 1 shown in FIG. 2 is not shown to facilitate illustration.

The heating furnace 2 is connected to the ingot preheating furnace 8 by an exhaust gas supply line 10 provided with an exhaust blower 11 and a heat exchanger 12. An exhaust gas G discharged from the heating furnace 2 is blown into the ingot preheating furnace 8 by the exhaust blower 11. The exhaust gas G of a temperature on the order of 900° C. flows through the heat exchanger 12 and heats combustion air A taken into the heat exchanger 12 by a blower 13. The temperature of the exhaust gas G drops to a temperature in the range of, for example, 350 to 450° C. after heating the combustion air A through the heat exchanger 12. The exhaust gas G is not discharged into the atmosphere and is supplied into the ingot preheating furnace 8. The exhaust gas G is discharged by a blower 14 into the atmosphere after being used as a heat source by the ingot preheating furnace 8.

A section of the exhaust gas supply line 10 between the heat exchanger 12 and the ingot preheating furnace 8 is provided with a temperature controller 15 to maintain the temperature of the exhaust gas below the melting point (460° C.)of the zinc ingots 6. The temperature controller 15 is called a TIC (temperature indicator controller) and has a control valve 16 and a temperature sensor 17 for measuring the temperature of the exhaust gas G. If the measured temperature of the exhaust gas G exceeds a set temperature, the control valve 16 opens properly to supply the atmosphere into the exhaust gas supply line 10 to maintain the exhaust gas G at temperatures below the set temperature. i.e., temperatures below the melting point of the zinc ingots 6.

Figure 3A:
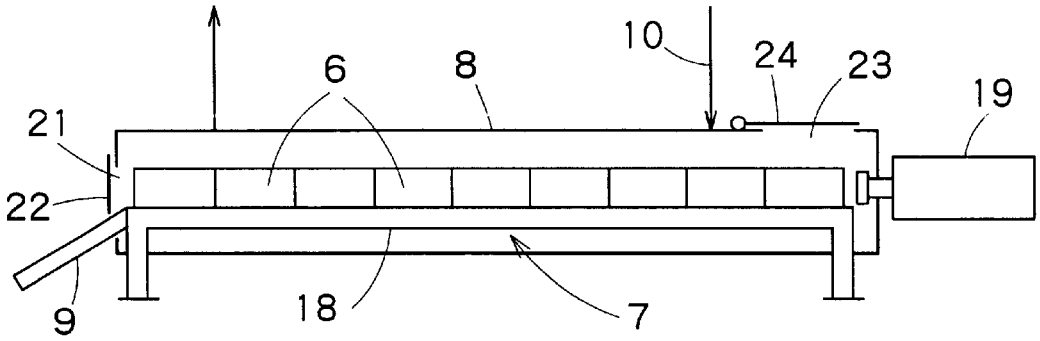
FIGS. 3A, 3B and 3C are schematic views of assistance in explaining the operation of an ingot carrying device included in the hot dipping apparatus shown in FIG. 1.
Figure 3B:
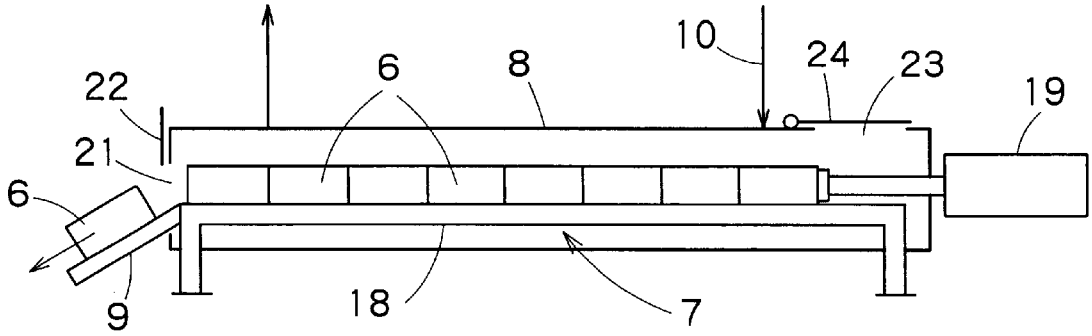

The ingot carrying device 7 is of a pusher system as shown in FIG. 3A. The ingot carrying device 7 has a support table 18 for supporting the zinc ingots 6 in a row thereon and a cylinder actuator 19, i.e., a pusher, for pushing the row of the zinc ingots 6. The ingot feed device 9, i.e., the sloping chute, is joined to the forward end of the support table 18. The zinc ingots 6 slide down along the ingot feed device 9 into the zinc melting furnace 3.

Figure 3C:
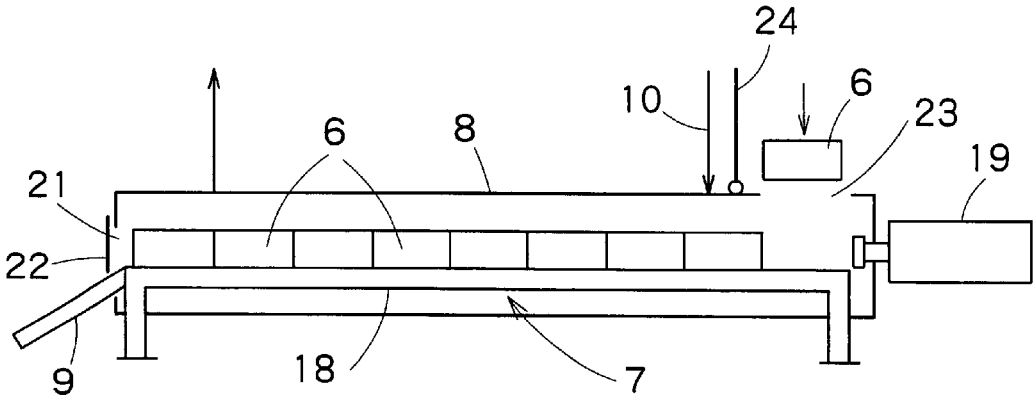

The ingot preheating furnace 8 has a forward end wall provided with an outlet 21 through which the zinc ingot 6 is pushed onto the ingot feed device 9. The outlet 21 is covered with an outlet shutter 22 after delivering the zinc ingot 6 onto the ingot feed device 9. As shown in FIG. 3C, the ingot preheating furnace has an upper wall provided with an inlet 23 at a position corresponding to the rearmost the row of zinc ingots 6. A new zinc ingot 6 is supplied through the inlet 23 into a vacant space formed on the support table 18 after feeding one of the zinc ingots 6 supported on the support table 18 into the zinc melting furnace 3 by pushing the zinc ingots 6 supported on the support table 18. Normally, the inlet 23 is covered with an inlet door 24 as shown in FIG. 3A. The ingot carrying device 7 of a simple pusher system can easily be enclosed by the ingot preheating furnace 8.

The operation of the hot dipping apparatus will be explained hereinafter. Referring to FIG. 1, the exhaust gas G discharged from the heating furnace 2 for heating or annealing the steel sheet 1 (FIG. 2) to be plated is blown by the exhaust blower 11 through the exhaust gas supply line 10 into the ingot preheating furnace 8. The temperature of the exhaust gas G as discharged from the heating furnace 2 is on the order of, for example, 900° C., which is far higher than the melting point of the zinc ingot 6. The heat of the exhaust gas G is transferred to the combustion air A, i.e., the atmosphere blown into the heat exchanger 12 by the blower 13, while the exhaust gas G flows through the heat exchanger 12 and the temperature of the exhaust gas G drops to a temperature in the range of, for example, about 350 to about 450° C.

The temperature of the exhaust gas G that has heated the combustion air A to be supplied into the heating furnace is adjusted to a set temperature, such as 350° C., below the melting point (460° C.) of the zinc ingot 6 by the temperature controller 15 before the exhaust gas G is supplied into the ingot preheating furnace 8. Consequently, the zinc ingots 6 being carried by the ingot carrying device 7 can be surely preheated at a temperature below the melting point of the zinc ingots 6. If it is conceived that the temperature of the exhaust gas G flowed through the heat exchanger 12 never exceeds the melting point of the zinc ingots 6, the temperature controller 15 may be omitted and the exhaust gas G flowed through the heat exchange 12 may be supplied directly to the ingot preheating furnace 8.

As shown in FIG. 2, the steel sheet 1 heated or annealed by the heating furnace 2 is fed continuously to the zinc melting furnace 3 and is dipped in the molten zinc prepared by melting the zinc ingots 6 and contained in the zinc melting furnace 3 to coat the steel sheet 1 with the molten zinc for a hot dipping process. When a predetermined quantity of the molten zinc contained in the zinc melting furnace 3 has been consumed as the hot dipping process is continued, the ingot feed device 7 shown in FIG. 1 is actuated to feed an amount of the zinc ingots 6 corresponding to the amount of the consumed molten zinc are fed by the ingot feed device 9 to replenish the zinc melting furnace 3 with the zinc ingots 6.

Since the zinc ingots 6 to be fed into the zinc melting furnace 3 is preheated by the ingot preheating furnace 8, the temperature of the molten zinc contained in the zinc melting furnace 3 does not vary greatly even if all the necessary number of the zinc ingots 6 are fed simultaneously by the ingot feed device 9 and the molten zinc is maintained stably at a set temperature, so that zinc plating quality is stabilized. The consumption rate of the molten zinc contained in the zinc melting furnace 3 is dependent on the coating mass of zinc on the hot-dip zinc-coated steel sheet. Therefore, time for which the zinc ingots 6 are kept on the support table 18 is not fixed. When the molten zinc is consumed at a low consumption rate, the zinc ingots 6 are held on the support table 18 for a long time and are preheated for a long time. However, since the zinc ingots 6 are preheated at a temperature below the melting point thereof, the zinc ingots 6 never melt while the same are kept and preheated on the support table 18.

Since the exhaust gas G discharged from the heating furnace 2 is used as a heat source for the ingot preheating furnace 8, the thermal efficiency of the hot dipping apparatus is higher than that of the conventional hot dipping apparatus.

Supposing the hot dipping apparatus operates in a mode expressed by:

temperature of exhaust gas G: 350° C.

exhaust gas discharge rate: 13600 $Nm^3/h$ heat of exhaust gas G: $1610\times10^3$ kcal/h zinc ingot melting rate: 4500 kg/h heat for preheating zinc ingots at 250° C.: 110250 kcal/h, then the heat recovery ratio achieved by the hot dipping apparatus is:

$$110250\times100/(1610\times10^3)\approx6.85\%$$

Figure 4A:
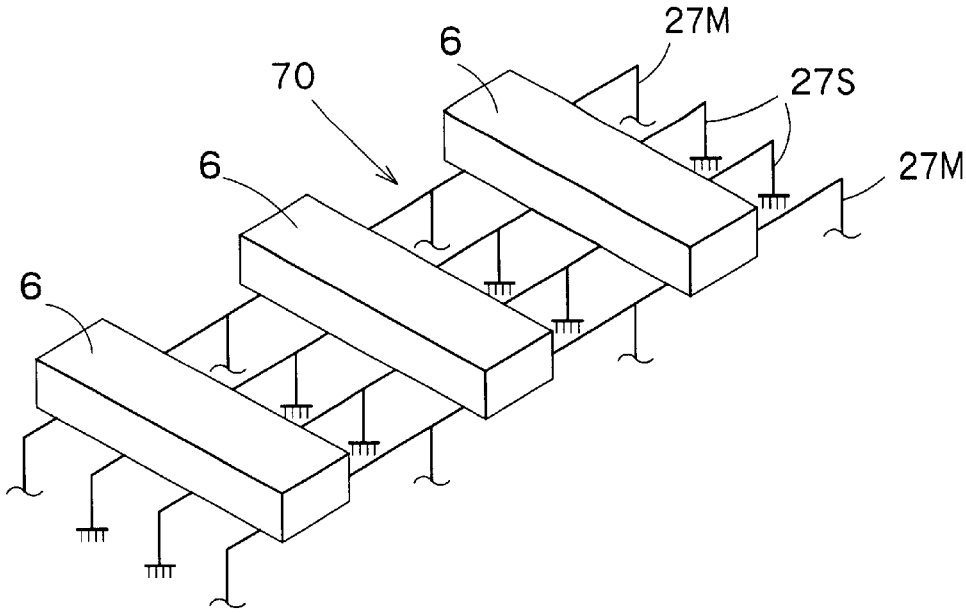
FIGS. 4A and 4B are a perspective view and a side elevation, respectively, of another ingot carrying device that may be employed in the hot dipping apparatus of the present invention.
Figure 4B:
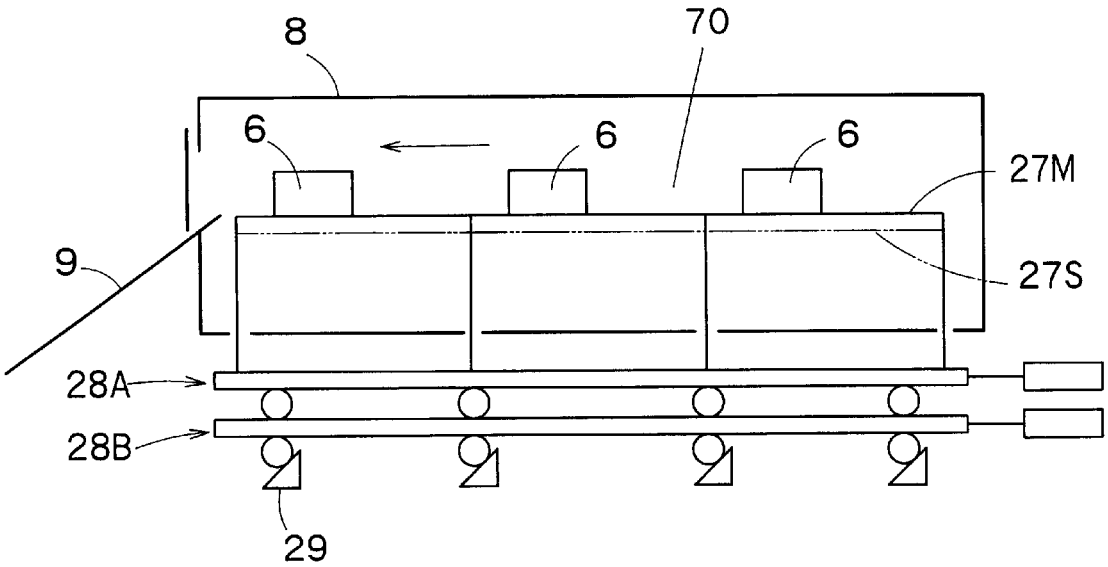
Figure 5A:
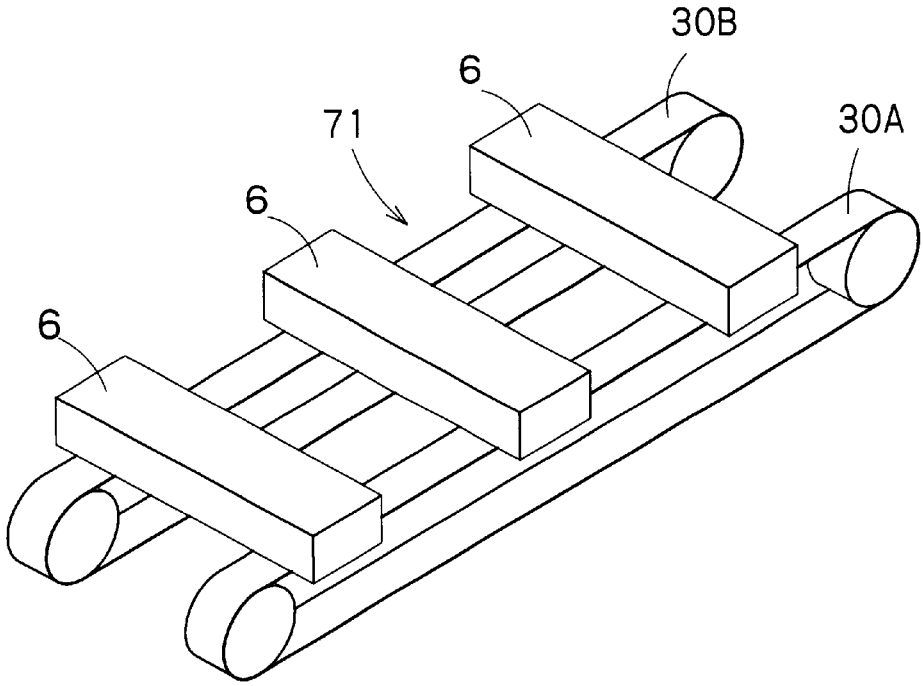
FIGS. 5A and 5B are a perspective view and a side elevation, respectively, of another ingot carrying device that may be employed in the hot dipping apparatus of the present invention.
Figure 5B:
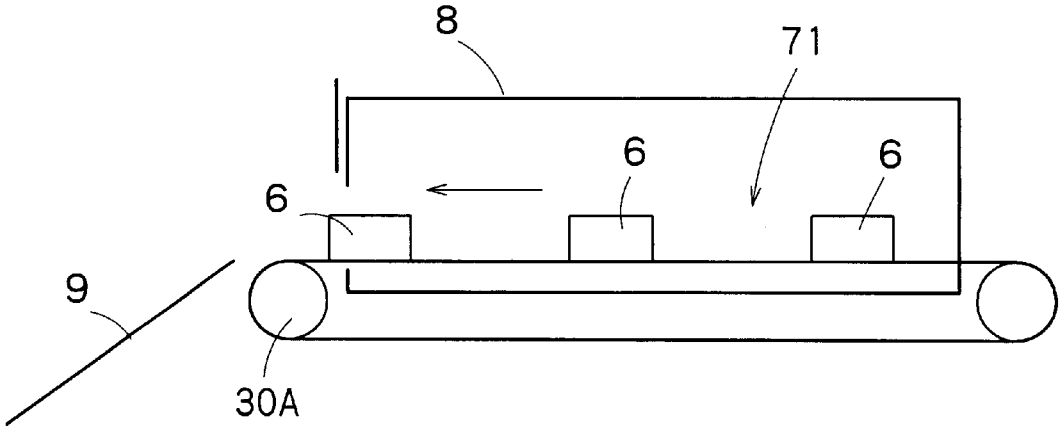

An ingot carrying device 70 of a walking beam system as shown in FIGS. 4A and 4B or an ingot carrying device 71 of a conveyor system as shown in FIGS. 5A and 5B may be used instead of the ingot carrying device 7 shown in FIGS. 1, 3A, 3B and 3C. The respective ingot carrying paths of the ingot carrying devices 70, 71 of a walking beam system and the conveyor system, similarly to that of the ingot carrying device 7 of a pusher system, can be enclosed by the ingot preheating furnace 8. The ingot carrying device 70 of a walking beam system shown in FIG. 4A supports and conveys ingots 6 by a plurality of stationary beams 27S and a plurality of movable beams 27M. As shown in FIG. 4B, the movable beams 27M have lower ends fixed to a support included in a first cart 28A, the wheels of the first cart 28A are on a support included in a second cart 28B, and the wheels of the second cart 28B are on the slopes of bases 29. The first cart 28A and the second cart 28B are reciprocated properly in horizontal directions so that the movable beams 27M are raised, moved forward (moved to the left), lowered and moved backward (moved to the right) repeatedly relative to the stationary beams 27S to advance the ingots 6 stepwise to the left, as viewed in FIG. 4B.

As shown in FIG. 5A, the ingot carrying device 71 of a conveyor system is provided with at least a pair of belt conveyors 30A and 30B for supporting and carrying ingots 6. The ingots 6 are conveyed to the left, as viewed in FIG. 5B by the belt conveyors 30A and 30B.

The ingot carrying devices 7, 70, 71 of a pusher system, a walking beam system and a conveyor system respectively shown in FIGS. 3A, 3B and 3C, 4A and 4B, and 5A and 5B are prevalently used in hot dipping apparatuses. The hot dipping apparatus in this embodiment is able to employ any one of those ingot carrying devices 7, 70, 71 without requiring any modification. Since those ingot carrying devices 7, 70, 71 are simple in construction, the ingot preheating furnace 8 is able to enclose one of those ingot carrying devices 7, 70, 71 without difficulty. The ingot preheating furnace 8 does not need any special heat source for preheating ingots 6 and uses the exhaust gas G discharged from the heating furnace 2 which is an essential component of the hot dipping apparatus. Therefore, the hot dipping apparatus according to the embodiment is simple in construction.

Although the invention has been described as applied to a hot dipping apparatus for zinc-plating a steel sheet, the present invention is applicable to hot dipping apparatuses for producing other plated products.

As is apparent from the foregoing description, the hot dipping apparatus according to the present invention operates at a high thermal efficiency and the temperature of the molten plating material does not become unstable when the ingot melting furnace is replenished with ingots because the ingots are preheated at a temperature below the melting point of the ingot by the exhaust gas discharged from the heating furnace.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A hot dipping apparatus comprising:

a heating furnace for heating or annealing a workpiece to be plated;

a melting furnace for melting an ingot of a plating material and containing a molten plating material in which the workpiece is immersed to be coated with the molten plating material for plating;

an ingot carrying device for carrying the ingot to a place near the melting furnace;

an ingot feed device for feeding the ingot carried by the ingot carrying device into the melting furnace;

an ingot preheating furnace mounted so as to enclose the ingot carrying device for preheating the ingot; and an exhaust gas line for supplying an exhaust gas discharged from the heating furnace to the ingot preheating furnace;

wherein the exhaust gas to be supplied into the ingot preheating furnace has a temperature below a melting point of the ingot.

2. The hot dipping apparatus according to claim 1 further comprising a temperature controller for maintaining the temperature of the exhaust gas to be supplied into the ingot preheating furnace below the melting point of the ingot.

3. The hot dipping apparatus according to claim 2, wherein the temperature controller has a temperature sensor for measuring the temperature of the exhaust gas to be supplied into the ingot preheating furnace, and a control valve which is opened when the temperature of the exhaust gas measured by the temperature sensor exceeds a set temperature to supply an atmosphere into the exhaust gas supply line to maintain the temperature of the exhaust gas to be supplied into the ingot preheating furnace below the melting point of the zinc ingot.

4. The hot dipping apparatus according to claim 1 further comprising a heat exchanger disposed in the exhaust gas line for heating a combustion air to be supplied into the heating furnace by the exhaust gas discharged from the heating furnace.

5. The hot dipping apparatus according to claim 1, wherein the ingot carrying device is of a pusher system having a pusher for pushing a row of the ingots.

6. The hot dipping apparatus according to claim 1, wherein the ingot carrying device is of a walking beam system having a stationary beam and a movable beam for advancing the ingot stepwise.

7. The hot dipping apparatus according to claim 1, wherein the ingot carrying device is of a conveyor system having a belt conveyor for conveying the ingot.

8. The hot dipping apparatus according to claim 1, wherein the ingot preheating furnace has an inlet which can be closed and an outlet which can be closed.

9. The hot dipping apparatus according to claim 1, wherein the plating material is a zinc and the workpiece to be plated is a steel sheet.

* * * * *